US007858279B2

(12) United States Patent
Halfyard et al.

(10) Patent No.: US 7,858,279 B2
(45) **Date of Patent: *Dec. 28, 2010**

(54) OVERPRINT COMPOSITIONS FOR XEROGRAPHIC PRINTS

(75) Inventors: Kurt I. Halfyard, Mississauga (CA); Gordon Sisler, St. Catherines (CA); T. Brian McAneney, Burlington (CA)

(73) Assignee: Xerox Corporation, Norwalk, CT (US)

( * ) Notice: Subject to any disclaimer, the term of this patent is extended or adjusted under 35 U.S.C. 154(b) by 1168 days.

This patent is subject to a terminal disclaimer.

(21) Appl. No.: 11/505,461

(22) Filed: Aug. 17, 2006

(65) Prior Publication Data

US 2007/0021522 A1 Jan. 25, 2007

Related U.S. Application Data

(63) Continuation-in-part of application No. 10/838,327, filed on May 5, 2004, now abandoned.

(51) Int. Cl.
*G03G 13/06* (2006.01)

(52) U.S. Cl. ..... 430/97; 430/31; 430/126.1; 430/126.2; 430/132

(58) Field of Classification Search ..... 430/31, 430/97, 126.1, 126.2, 132
See application file for complete search history.

(56) References Cited

U.S. PATENT DOCUMENTS 4,070,262 A 1/1978 Guarino et al.
4,071,425 A 1/1978 Guarino et al.
4,072,592 A 2/1978 Du et al.
4,072,770 A 2/1978 Ting
4,092,173 A 5/1978 Novak et al.
4,133,909 A 1/1979 Spencer
4,227,979 A 10/1980 Humke et al.
4,265,976 A 5/1981 Nowak
4,265,990 A 5/1981 Stolka et al.
4,426,431 A 1/1984 Harasta et al.
4,477,548 A * 10/1984 Harasta et al. ..... 430/14
4,563,408 A 1/1986 Lin et al.
4,584,253 A 4/1986 Lin et al.
4,585,884 A 4/1986 Lin et al.
5,095,012 A 3/1992 Okita et al.
5,162,389 A 11/1992 Lee et al.
5,219,641 A 6/1993 Mehta et al.
5,223,368 A 6/1993 Ciccarelli et al.
5,346,795 A 9/1994 Pickering et al.
5,366,840 A 11/1994 Larson et al.
5,612,777 A 3/1997 Malhotra
5,627,002 A 5/1997 Pan et al.
5,703,141 A 12/1997 Jin (Continued)

FOREIGN PATENT DOCUMENTS

EP 0 823 670 A1 2/1998

*Primary Examiner*—Mark F Huff
*Assistant Examiner*—Peter L Vajda
(74) *Attorney, Agent, or Firm*—Oliff & Berridge, PLC

(57) ABSTRACT

Xerographic prints with a toner-based image and an overprint, said overprint based on radiation curable compositions containing a radiation curable oligomer/monomer, at least one photoinitiator and at least one surfactant, are disclosed. The overprints are particularly well-suited for wetting over substrates containing residual fuser oil and reducing or preventing document offset and for protecting xerographic images on substrates subjected to abrasives, heat, and/or sunlight since the compositions protect such images from cracking, fading, and smearing.

23 Claims, 10 Drawing Sheets

UNVARNISHED TONER TO UNVARNISHED PAPER

VARNISHED PAPER TO UNVARNISHED TONER

U.S. PATENT DOCUMENTS 5,800,884 A 9/1998 D'Anna et al.
5,826,147 A 10/1998 Liu et al.
5,905,012 A 5/1999 De Meutter et al.
5,966,570 A 10/1999 Till et al.
6,162,511 A * 12/2000 Garnett et al. ..... 427/514
6,180,308 B1 1/2001 Pan et al.
6,187,499 B1 2/2001 Zhao et al.
6,197,844 B1 3/2001 Hamrock et al.
6,212,347 B1 4/2001 Zhao et al.
6,309,754 B1 * 10/2001 Visser et al. ..... 428/446
7,462,401 B2 * 12/2008 Halfyard et al. ..... 428/500
7,521,165 B2 * 4/2009 Anderson et al. ..... 430/126.1
2002/0121631 A1 9/2002 Rahman et al.
2003/0207192 A1 * 11/2003 Hirota et al. ..... 430/108.4
2005/0249895 A1 11/2005 Sisler et al.
2005/0250038 A1 11/2005 McAneney et al.

* cited by examiner

OVERPRINT COMPOSITIONS FOR XEROGRAPHIC PRINTS

This is a Continuation-in-Part of U.S. patent application Ser. No. 10/838,327, filed May 5, 2004. The entire disclosure of the prior application is hereby incorporated by reference in its entirety.

BACKGROUND OF THE INVENTION

1. Field of Invention

The present invention generally relates to overprint compositions for xerographic prints. The overprint compositions provide a number of advantages to xerographic prints, such as, for example, image permanence, thermal stability, lightfastness, and smear resistance. In addition, the overprint compositions reduce document offset.

2. Description of Related Art

In conventional xerography, electrostatic latent images are formed on a xerographic surface by uniformly charging a charge retentive surface, such as a photoreceptor. The charged area is then selectively dissipated in a pattern of activating radiation corresponding to the original image. The latent charge pattern remaining on the surface corresponds to the area not exposed by radiation. Next, the latent charge pattern is visualized by passing the photoreceptor past one or more developer housings comprising toner, which adheres to the charge pattern by electrostatic attraction. The developed image is then fixed to the imaging surface or is transferred to a receiving substrate, such as paper, to which it is fixed by a suitable fusing technique, resulting in a xerographic print or toner-based print.

Although xerographic equipment is used worldwide, it possesses a significant disadvantage in that the energy consumption is quite high. Thus, equipment with lower power consumption has been designed. Toners that function in the lower power consumption equipment, known as "low-melt toners," are designed to have low glass transition temperatures ($T_g$'s) of about 55° C. to about 65° C. However, an image defect known as document offset (or "blocking") can occur at temperatures as low as about 54° C. to as high as about 70° C. or more when the toner begins to flow. Thus, low-melt toners often have a significant document offset problem. Document offset properties of various toners are set forth in Table 1.

TABLE 1

Comparison of Document Offset Properties of Various Low-Melt Toners

| Toner | Machine | Temperature* |
|---|---|---|
| FC II | DC2060 & DC12 | 62° C. (144° F.) |
| FC I | DC40 & Majestik ® (Xerox Corp.) | 61° C. (142° F.) |
| 5090 | DT180 | 55.5° C. (132° F.) |
| C6 & M4 | iGen3 ® (Xerox Corp.) | 55.5° C. (132° F.) |

*where Document Offset (DO) = 4.0 @ 10 g/cm$^2$

At document offset-provoking temperatures, when combined with pressure, such as several reams of paper in an output tray of a printer, the toner sticks to the sheet above it, or, in the case of duplex printing, the toner on the sheet above it. This yields two sheets that have to be pulled apart. In the worse case scenario, the toner pulls off part of the image on or paper fibers from the sheet above it. Clearly, this results in a loss of quality of the toner-based print (also referred to as a toner-based image, xerographic print, or xerographic image).

Known methods of reducing document offset include adding wax to the toner and applying an overprint coating to the substrate. The overprint coating, often referred to as an overprint varnish or composition, is typically a liquid film coating that may be dried and/or cured. Curing may be accomplished through drying or heating or by applying ultraviolet light or low voltage electron beams to polymerize (crosslink) the components of the overcoat. However, known overprint coatings, such as those described in U.S. Pat. Nos. 4,070,262, 4,071,425, 4,072,592, 4,072,770, 4,133,909, 5,162,389, 5,800,884, 4,265,976, and 5,219,641, for example, fail to adequately protect xerographic prints and fail to reduce document offset.

In addition, known coating formulations fail to prevent the formation of hairline cracks on the print surface in response to thermal expansion of the toner, which creates an undesirable appearance. This is a particularly important issue for automobile manuals, book covers, etc., which require the prints therein to survive high temperatures for hours at a time, yet retain a neat appearance.

Moreover, known coating formulations fail to protect xerographic prints from bead-up and smears caused by overwriting on the print with liquid markers. The ability to neatly overwrite without beading and smearing is vital for numerous commercial applications, such as, for example, restaurant menus and calendars.

Accordingly, a need exists for a xerographic print protective composition that provides overprint coating properties including, but not limited to, thermal and light stability and smear resistance, particularly in commercial print applications. More specifically, a need exists for an overprint coating that has the ability to wet over silicone fuser oil (generally found on xerographic substrates), permit overwriting, reduce or prevent thermal cracking, reduce or prevent document offset, and protect an image from sun, heat, etc. The compositions and processes of the present invention, wherein a xerographic print is coated with a radiation curable overprint composition, satisfies this need.

SUMMARY OF THE INVENTION

The present invention is directed to solvent-free, overprint compositions and methods for overcoating, and thus protecting, xerographic prints. The compositions reduce document offset at temperatures up to at least about 70-100° C., reduce or prevent thermal cracking, and protect prints from bead-up and smears caused by overwriting using, for example, liquid ink markers, such as, for example, Sharpie® pens and highlighters. In addition, the inventive overprint compositions improve the overall appearance of xerographic prints due to the ability of the compositions to fill in the roughness of xerographic substrates and toners, thereby forming a level film and enhancing glossiness. This is desirable in reducing or eliminating differential gloss that is often observed when different pile heights of toner are applied to make a color image, for example. It is especially noticeable when a black portion of an image is adjacent to a nearly white portion of the image. With the inventive overprint composition applied, the difference is negligible.

The invention further relates to xerographic prints comprising an ultraviolet (UV) curable overprint composition applied to at least one surface of the print, preferably, applied to the top of the substrate and/or the fused-toner image. The UV curable composition comprises a homogeneous mixture of UV curable oligomers, monomers, photoinitiators, and surfactants. By coating a xerographic print with the inventive composition, the toner is effectively buried beneath an overcoat, which essentially forms a protective barrier on the print preventing, inter alia, undesirable toner-to-toner and toner-to-substrate interactions.

BRIEF DESCRIPTION OF THE DRAWINGS

The patent or application file contains at least one drawing executed in color. Copies of this patent or patent application publication with the color drawings will be provided by the U.S. patent and Trademark Office upon request and payment of the necessary fee.

DETAILED DESCRIPTION OF PREFERRED EMBODIMENTS

Figure 1A:
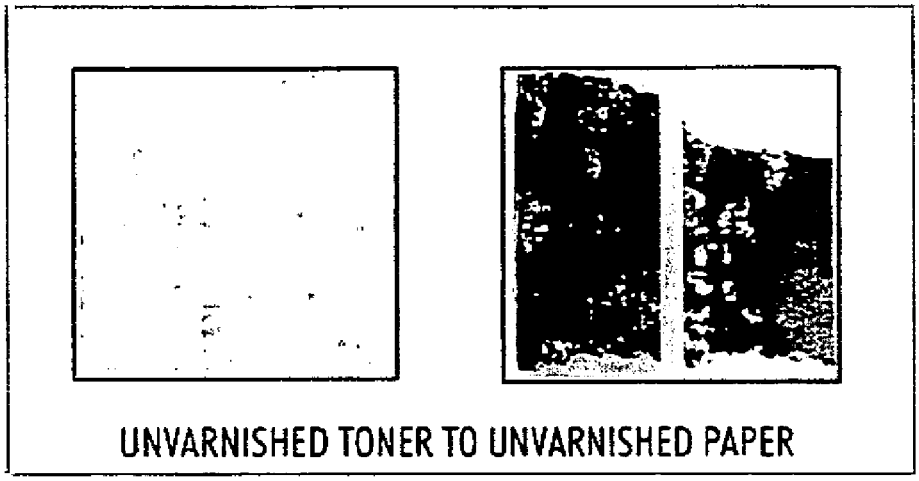
FIGS. 1A-1D are photographs comparing xerographic prints and paper with and without an inventive overprint composition coating.

The present invention provides solvent-free, radiation curable overprint compositions comprising a radiation curable oligomer/monomer, at least one photoinitiator, and at least one surfactant.

In the uncured state, the composition is a low viscous liquid. Upon exposure to a suitable source of curing energy, e.g., ultraviolet light, electron beam energy, etc., the photoinitiator absorbs the energy and sets into motion a reaction that converts the liquid composition into a cured overcoat. The monomer and oligomer in the composition contain functional groups that polymerize during exposure to the curing source and readily crosslink forming a polymer network. This polymer network provides xerographic prints with, for example, thermal and light stability and smear resistance. Thus, the composition is particularly well-suited for coating images on substrates subjected to heat and sunlight since the composition protects the image from cracking and fading, provides image permanence, and allows for overwriting in the absence of smearing and beading. In addition, the compositions reduce or prevent document offset at temperatures up to at least about 70-100° C., depending on the pressure, and thus can be used on prints containing low-melt toners.

Another advantage of the overprint compositions is its ability to protect xerographic prints from electron beam irradiation, such as the type of irradiation used on certain mail addressed to particular United States governmental agencies to kill bacteria and viruses. Very high irradiation levels are required at temperatures of about 95-110° C., causing visible steaming. Thus, irradiated mail is often yellow and paper is often brittle. Compact disks, floppy disks, and other plastics melt and do not survive the irradiation process. In addition, most xerographic printed documents suffer from document offset, and thus stick together, after irradiation. The overprint compositions allow such documents to survive irradiation intact.

Overprint Compositions

The overprint compositions comprise, in general, at least one radiation curable oligomer/monomer, at least one photoinitiator, and at least one surfactant. More specifically, the overprint compositions comprise at least one acrylated oligomer, polyether, or polyester acrylate, such as, for example, a high molecular weight, low viscosity, unsaturated trifunctional acrylic resin; at least one low surface tension, low viscosity di- or tri-functional acrylate monomer; at least one UV-photoinitiator used to initiate the photopolymerization, i.e., curing, of the chemically unsaturated prepolymer (oligomer and monomer); and at least one surfactant.

The oligomer component of the composition is preferably relatively hydrophobic. Such oligomers help provide the radiation-cured layer of the print with the requisite moisture barrier properties because, as the hydrophobicity of the oligomer increases, the moisture barrier properties improve. As a result, moisture is less likely to permeate into the base paper, which minimizes paper cockling and curling. Suitable acrylated oligomers include, but are not limited to, acrylated polyesters, acrylated polyethers, acrylated epoxys, and urethane acrylates. Preferred oligomers include, but are not limited to, polyether acrylate oligomers, having the basic structure:

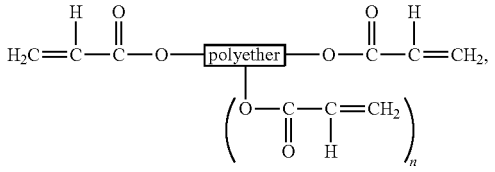

such as, for example, Laromer® PO94F (BASF Corp., Charlotte, N.C.), an amine-modified polyether acrylate oligomer.

The monomer functions as a viscosity reducer, as a binder when the composition is cured, and as an adhesion promoter, and as a crosslinking agent, for example. Suitable monomers have a low molecular weight, low viscosity, and low surface tension and comprise functional groups that undergo polymerization upon exposure to UV light. The monomers are preferably polyfunctional alkoxylated or polyalkoxylated acrylic monomers comprising one or more di- or tri-acrylates. Suitable polyfunctional alkoxylated or polyalkoxylated acrylates may be selected from alkoxylated, preferably, ethoxylated, or propoxylated, variants of the following: neopentyl glycol diacrylates, butanediol diacrylates, trimethylolpropane triacrylates, and glyceryl triacrylates. In a more preferred embodiment, the monomer is a propoxylated$_2$ neopentyl glycol diacrylate, such as, for example, SR-9003 (Sartomer Co., Inc., Exton, Pa.), having the structure:

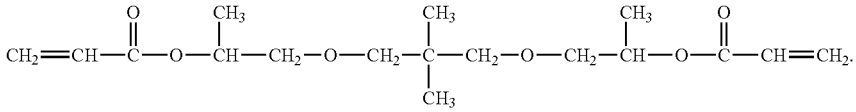

Suitable photoinitiators are UV-photoinitiators, including, but not limited to, hydroxycyclohexylphenyl ketones, benzoins, benzoin alkyl ethers, benzophenones, trimethylbenzoylphenylphosphine oxides, azo compounds, anthraquinones and substituted anthraquinones, such as, for example, alkyl substituted or halo substituted anthraquinones, other substituted or unsubstituted polynuclear quinones, acetophenones, thioxanthones, ketals, acylphosphines, and mixtures thereof. More preferably, the photoinitiator is one of the following compounds or a mixture thereof: a hydroxyclyclohexylphenyl ketone, such as, for example, 1-hydroxycyclohexylphenyl ketone, such as, for example, Irgacure® 184 (Ciba-Geigy Corp., Tarrytown, N.Y.), having the structure:

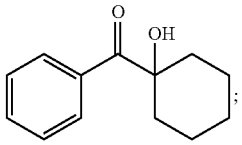

a trimethylbenzoylphenylphosphine oxide, such as, for example, ethyl-2,4,6-trimethylbenzoylphenylphosphinate, such as, for example, Lucirin® TPO-L (BASF Corp.), having the structure:

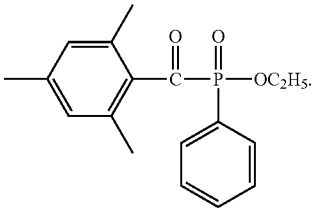

In some embodiments, a mixture of two to five different photoinitiators may be used.

The fourth main ingredient, a surfactant, is generally used to lower the surface tension of the composition to allow wetting and leveling of the substrate surface, if necessary, before curing. Any surfactant that has this capability may be used. Preferred surfactants include, but are not limited to, fluorinated alkyl esters, polyether modified polydimethylsiloxanes, having the structure:

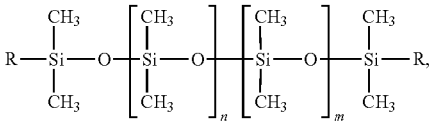

wherein the R groups are functional modifications, such as, for example, BYK®-UV3510 (BYK Chemie GmbH, Wesel, Germany), and BYK®-348 (BYK Chemie GmbH), such as, for example, BYK®-UV3510 (BYK Chemie GmbH, Wesel, Germany) and BYK®-348 (BYK Chemie GmbH), and fluorosurfactants, such as, for example, Zonyl® FSO-100 (E.I. Du Pont de Nemours and Co., Wilmington, Del.), having the formula $R_fCH_2CH_2O(CH_2CH_2O)_xH$, wherein $R_f$=F $(CF_2CF_2)_y$, x=0 to about 15, and y=1 to about 7. In some embodiments, a mixture of two to five different surfactants may be used.

Optional additives include, but are not limited to, light stabilizers, UV absorbers, which absorb incident UV radiation and convert it to heat energy that is ultimately dissipated, antioxidants, optical brighteners, which can improve the appearance of the image and mask yellowing, thixotropic agents, dewetting agents, slip agents, foaming agents, antifoaming agents, flow agents, waxes, oils, plasticizers, binders, electrical conductive agents, fungicides, bactericides, organic and/or inorganic filler particles, leveling agents, e.g., agents that create or reduce different gloss levels, opacifiers, antistatic agents, dispersants, pigments and dyes, and the like. The composition may also include an inhibitor, preferably a hydroquinone, to stabilize the composition by prohibiting or, at least, delaying, polymerization of the oligomer and monomer components during storage, thus increasing the shelf life of the composition. However, additives may negatively effect cure rate, and thus care must be taken when formulating an overprint composition using optional additives.

The ability of the composition to wet the substrate generally depends on its viscosity and surface tension. For example, if the surface tension is low, then the surface area covered by the composition will be high resulting in sufficient wetting of the substrate. Preferred composition formulations have a surface tension ranging from about 15 dynes/cm to about 40 dynes/cm, and, more preferably, ranging from about 18 dynes/cm to about 21 dynes/cm, as measured at about 25° C. The preferred surface tension is about 20 dynes/cm as measured at about 25° C.

The viscosities of the compositions before curing range from about 50 cP to about 300 cP, depending on the temperature. For example, the viscosity of an overprint composition before curing may be in a range of from about 50 cP to about 300 cP at a temperature of about 25° C. Preferably, the viscosity of the compositions ranges from about 100 cP to about 200 cP at a temperature ranging from about 20° C. to about 30° C. A more preferred viscosity is about 100 cP at about 25° C. To obtain an acceptable viscosity, the preferred oligomer: monomer ratio is about 0.67:1 to about 9:1, more preferably, from about 1.5:1 to about 4:1.

The composition components are preferably mixed together in the following order: about 60 to about 70% oligomer including, but not limited to, a polyether acrylate oligomer, such as, for example, Laromer® PO94F (BASF Corp.) in a concentration of about 67.8%; about 20 to about 40% monomer including, but not limited to, a propoxylated$_2$ neopentyl glycol diacrylate, such as, for example, SR-9003 (Sartomer Co., Inc.) in a concentration of about 27%; about 2.0 to about 7.0% UV-photoinitiator, including, but not limited to, 1-hydroxyclyclohexylphenyl ketone, such as, for example, Irgacure® 184 (Ciba-Geigy Corp.) in a concentration of about 5.1%; and about 0.05 to about 5.0% surfactant, more preferably, about 0.1 to about 1.0% surfactant, including, but not limited to, a polyether modified polydimethylsiloxane, such as, for example, BYK®-UV3510 (BYK Chemie GmbH) in a concentration of about 0.1%. The components are combined and mixed with brief agitation using, preferably, a magnetic stir bar or overhead mixer between each addition, followed by a minimum of about two hours of stirring until the oligomer is dissolved. The formulation can be heated to reduce viscosity, if necessary. Thus, an exemplary overprint composition may comprise about 30 to about 80 wt % of an amine-modified polyether acrylate, about 20-40% polyalkoxylated acrylic monomer, about 2 to about 7 wt % of the photoinitiator, and about 0.05 to about 5 wt % of the surfactant.

Overprint Composition Application Methods

The composition can be applied to any type of xerographic substrate, such as, for example, paper, including wherein the substrate has a residue of fuser-oil (functionalized silicone oil), to completely wet the surface with no surface reaction optionally comprising additives coated thereon. The substrate can contain additives including, but not limited to, anti-curl compounds, such as, for example, trimethylolpropane; biocides; humectants; chelating agents; and mixtures thereof; and any other optional additives well known in the xerographic art for enhancing the performance and/or value of the toner and/or substrate.

The composition can be applied to the substrate at any suitable time after image formation and can be applied over the entire substrate, the entire image, parts of the substrate, or parts of the image. Preferably, the toner-based image on the substrate has been previously prepared by any suitable xerographic process comprising, for example, generating an electrostatic image, developing the electrostatic image with toner, and transferring the developed toner-based image to a substrate, or modifications thereof, well-known in the art of xerography.

More specifically, methods for generating images coated with the overprint compositions disclosed herein comprise: generating an electrostatic latent image on a photoconductive imaging member, developing the latent image with toner, transferring the developed electrostatic image to a substrate, coating the substrate or parts thereof and/or image or parts thereof with an overprint composition, and curing the composition. Development of the image can be achieved by a number of methods known in the art, such as, for example, cascade, touchdown, powder cloud, magnetic brush, and the like. Transfer of the developed image to the substrate can be by any method, including, but not limited to, those making use of a corotron or a biased roll. The fixing step can be performed by means of any suitable method, such as, for example, flash fusing, heat fusing, pressure fusing, vapor fusing, and the like. Suitable imaging methods, devices, and systems are known in the art and include, but are not limited to, those described in U.S. Pat. Nos. 4,585,884, 4,584,253, 4,563,408, 4,265,990, 6,180,308, 6,212,347, 6,187,499, 5,966,570, 5,627,002, 5,366,840; 5,346,795, 5,223,368, and 5,826,147, the entire disclosures of which are incorporated herein by reference.

Conventional liquid film coating devices can be used for applying the overprint composition, including, but not limited to, roll coaters, rod coaters, blades, wire bars, dips, air-knives, curtain coaters, slide coaters, doctor-knives, screen coaters, gravure coaters, such as, for example, offset gravure coaters, slot coaters, and extrusion coaters. Such devices can be used in their conventional manner, such as, for example, direct and reverse roll coating, blanket coating, dampner coating, curtain coating, lithographic coating, screen coating, and gravure coating. In a preferred embodiment, coating and curing of the composition are accomplished using a two or three roll coater with a UV curing station. Typical composition deposition levels, expressed as mass per unit area, range from about 1 $g/m^2$ to about 10 $g/m^2$, and are preferably, about 5 $g/m^2$.

The overprint compositions of embodiments may be applied over toner-based images and substrates that have residual fuser oil or residual release oil present on the print. These residual oils may be silicon oils, such as polydimethylesiloxanes, and/or functionalized silicon oils, such as amino-functionalized PDMS oils and mercapto-functionalized PDMS oils. These residual oils may cover between 5% to 100% of the area of the toner-based image and substrate. These residual oils may cover the toner-based image and substrate at levels over from 0. to 50 $\mu g/cm^2$. The surface energy in areas covered by these residual oils may be as low as 15 mN/m.

The energy source used to initiate crosslinking of the radiation curable oligomer and monomer components of the composition can be actinic, e.g., radiation having a wavelength in the ultraviolet or visible region of the spectrum, accelerated particles, e.g., electron beam radiation, thermal, e.g., heat or infrared radiation, or the like. Preferably, the energy is actinic radiation because such energy provides excellent control over the initiation and rate of crosslinking. Suitable sources of actinic radiation include, but are not limited to, mercury lamps, xenon lamps, carbon arc lamps, tungsten filament lamps, lasers, sunlight, and the like.

Ultraviolet radiation, especially from a medium pressure mercury lamp with a high speed conveyor under UV light, e.g., about 20 to about 70 m/min., is preferred, wherein the UV radiation is provided at a wavelength of about 200 to about 500 nm for about less than one second. More preferably, the speed of the high speed conveyor is about 15 to about 35 m/min. under UV light at a wavelength of about 200 to about 450 nm for about 10 to about 50 milliseconds (ms). The emission spectrum of the UV light source generally overlaps the absorption spectrum of the UV-initiator. Optional curing equipment includes, but is not limited to, a reflector to focus or diffuse the UV light, and a cooling system to remove heat from the UV light source.

The invention will be illustrated further in the following nonlimiting Examples. The Examples are intended to be illustrative only. The invention is not intended to be limited to the materials, conditions, process parameters, and the like, recited herein. Parts and percentages are by weight unless otherwise indicated.

EXAMPLES

Example 1

Overprint Composition Formulation

The components of the overprint composition were combined in the following order with brief agitation between each addition with an overhead mixer: 67.8% amine modified polyether acrylate oligomer (3388 grams Laromer® PO94F (BASF Corp.)), 27% propoxylated$_2$ neopentyl glycol diacrylate (1351 grams SR-9003 (Sartomer Co., Inc.)), 5.1% UV photoinitiator (1-hydroxyclyclohexylphenyl ketone (241 grams Irgacure® 184 (Ciba-Geigy Corp.)) and ethyl-2,4,6-trimethylbenzoylphenylphosphinate (15 grams Lucirin® TPO-L (BASF Corp.))), and 0.1% polyether modified polydimethylsiloxane (5.0 grams BYK®-UV3510 (BYK Chemie GmbH)). The mixture was stirred at room temperature for about four hours at high shear with an overhead mixer until the oligomer dissolved.

The overprint composition was coated on a variety of xerographic prints at a thickness of about 5 microns. The composition was subsequently cured using a Dorn SPE three roll coater (Dorn SPE, Inc.) with a UV curing station housing a medium pressure mercury lamp with a high speed UV light (about 15 to about 35 m/min.) and a UV wavelength of about 200 to about 450 nm.

Example 2

Document Offset—Comparative Example using an iGen3® (Xerox Corp.) Toner

Using the overprint composition of Example 1, coated and uncoated xerographic prints and coated and uncoated xerographic paper were subjected to conditions of 70° C. at 50% relative humidity (r.h.) under 80 g/cm$^2$ pressure for 24 hours. An iGen3® (Xerox Corp.) toner, a low-melt toner with a $T_g$ of about 55° C., was used on the prints.

Figure 1B:
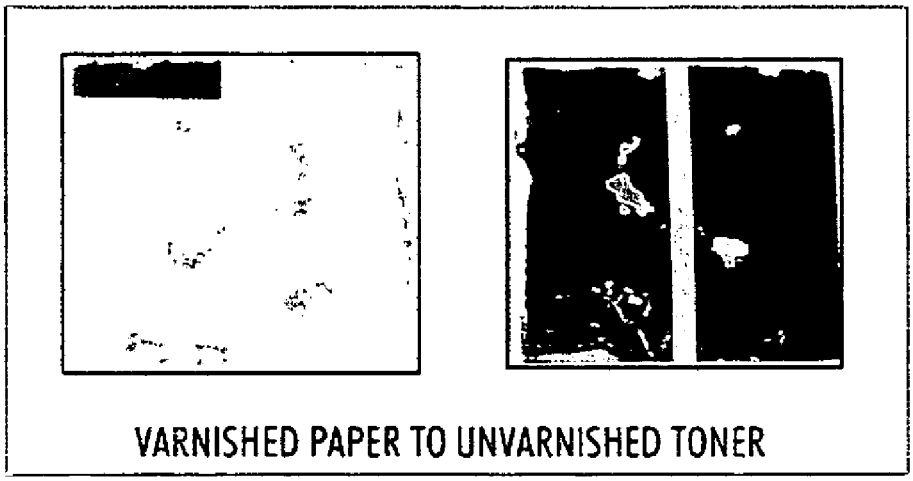
Figure 1C:
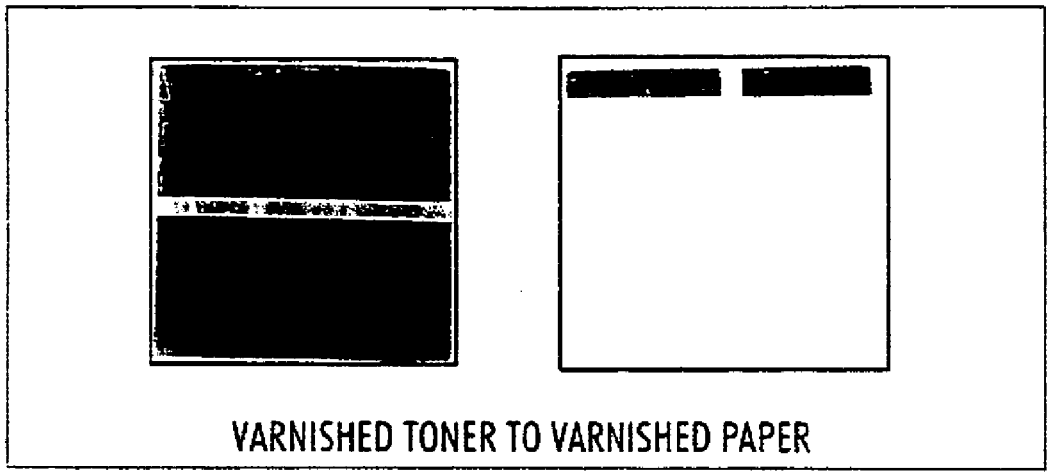
Figure 1D:
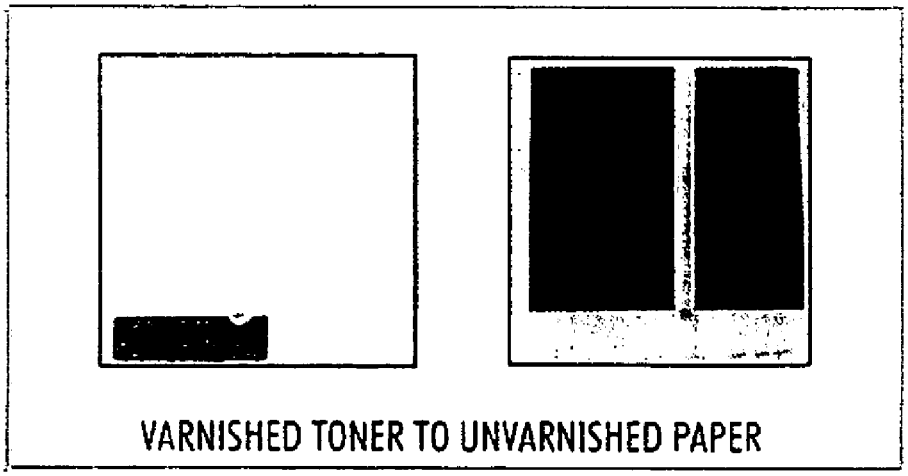

As illustrated in FIGS. 1A-1D, the overprint composition improved document offset (DO) from a grade of 0 (total substrate and toner failure) to a grade of 4.5 (no visible DO, slight tack between samples) on a scale of 0 (worst)-5 (best) (Table 2). FIG. 1A illustrates that toner from an uncoated print transferred to uncoated paper (DO=0). FIG. 1B illustrates that toner from a coated paper transferred to an uncoated print (DO=0). FIG. 1C illustrates that toner from a coated print did not transfer to coated paper (DO=4.5). FIG. 1D illustrates that toner from a coated print did not transfer to uncoated paper (DO=4.5). These figures illustrate the ability of the overprint composition to protect the image on a xerographic print from document offset of the toner to either blank paper or another toner-based image.

TABLE 2

Document Offset Standard Chart

| Grade | Judgment Standard | Pass/Fail |
|---|---|---|
| 5.0 | No adhesion, no damage | Pass |
| 4.5 | Partial adhesion but no damage | Pass |
| 4.0 | Partial adhesion, very few minor damage | Pass/Fail |
| 3.5 | Adhesion, minor damage | Fail |
| 3.0 | Adhesion, damage up to ⅓ of image area | Fail |
| 2.0 | Adhesion, damage ⅓ to ½ of image area | Fail |
| 1.0 | Adhesion, damage more than ½ of image area | Fail |
| 0.0 | Paper failure | Fail |

Figure 2:
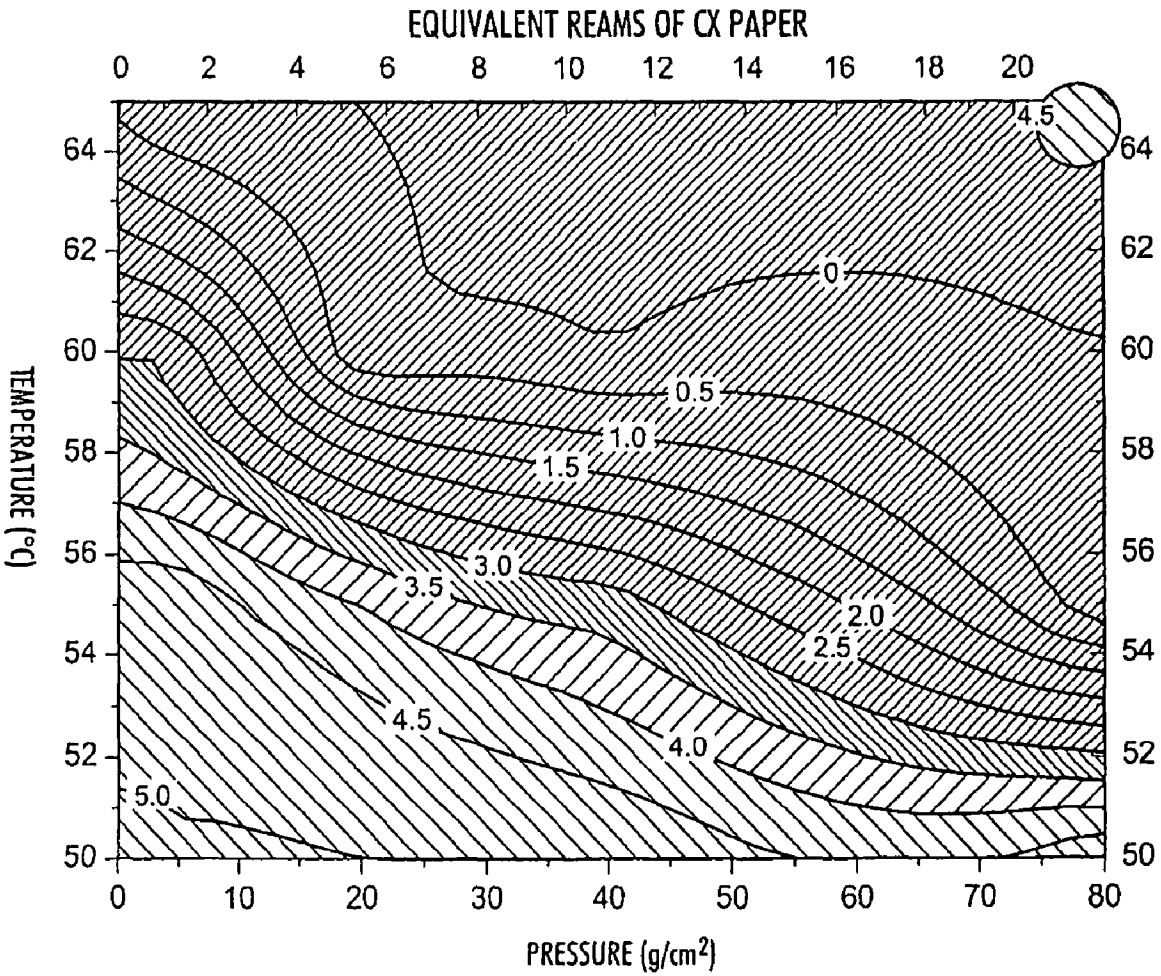
FIG. 2 is a graph illustrating document offset for iGen3® (Xerox Corp.) toner (uncoated) on Xerox® Digital Colour Gloss (DCG) paper (80 lb coated). The spot represents the same area, only with an inventive overprint composition applied to the print.

The improvement in DO can also been expressed on a document offset map, as noted in FIG. 2 wherein the spot (DO=5.0) represents the same area (70° C.; 80 g/cm$^2$), only with overprint composition applied to the print.

Example 3

Document Offset—Comparative Example using FCII Toner (Fuji Xerox Corp.)

Using the overprint composition of Example 1, coated and uncoated xerographic prints were subjected to various pressures (4-80 g/cm$^2$) and temperatures (60-90° C.) at 50% r.h. for 24 hours. FCII toner, a low-melt toner with a $T_g$ of about 62° C. from Fuji Xerox Corp., was used on the prints. The results were graded on a scale of 0 (worst)-5 (best) (Table 2) and mapped (FIGS. 3A-3B).

Figure 3A:
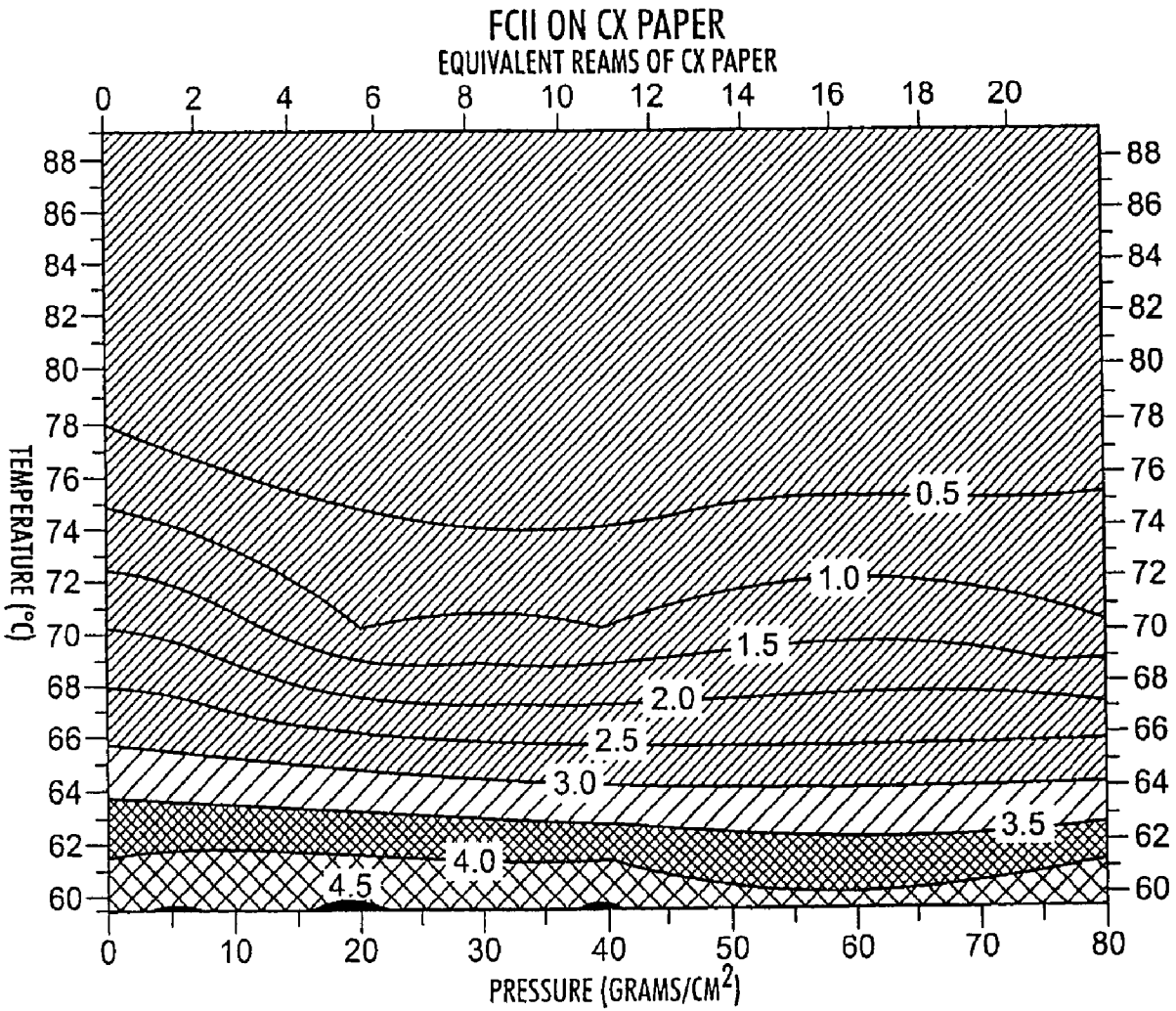
FIG. 3A is a graph illustrating document offset on an uncoated print with FCII toner (Fuji Xerox Corp).
Figure 3B:
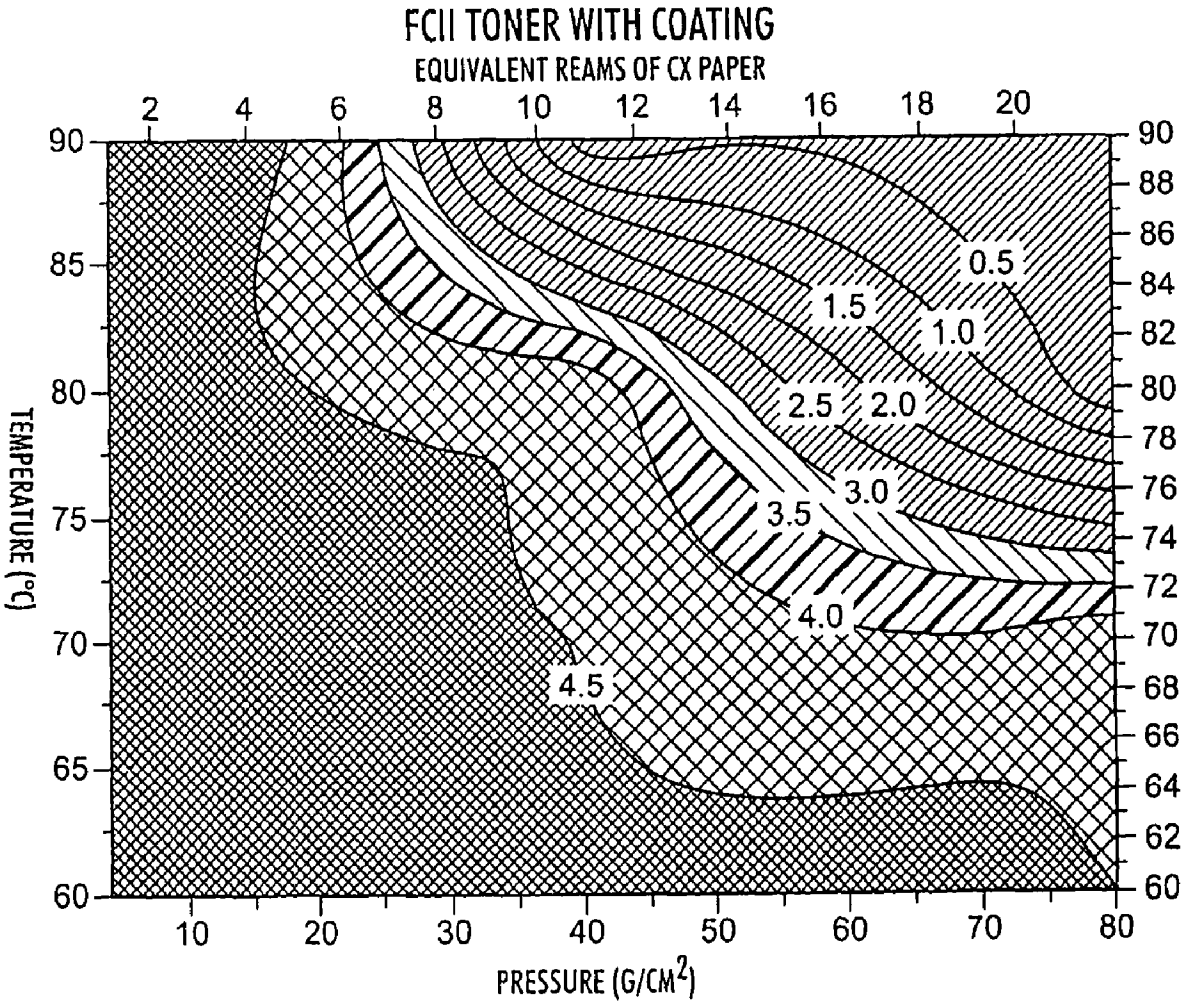
FIG. 3B is a graph illustrating document offset on a print with FCII toner (Fuji Xerox Corp.) coated with an inventive overprint composition.

FIG. 3A shows that on an FCII toner-based print without the overprint composition, document offset failure begins at approximately 62° C. FIG. 3B shows that on an FCII toner-based print with the overprint composition, document offset failure begins above 70° C. at high pressure and above 90° C. at low pressure.

Example 4

Surface Smoothing and Gloss Improvement

The overprint composition of Example 1 was applied to some xerographic prints, but not to other xerographic prints, to illustrate that the overprint composition greatly reduces differential gloss as it creates a level surface where previously there was a non-level surface. An improvement of more than 40 ggu was observed after the overprint composition was applied prints and cured (Table 3).

TABLE 3

Gloss on FCII Toner-Based Prints

| Print | Gloss (ggu) |
|---|---|
| uncoated | 51.6 ± 0.4 |
| coated with overprint composition | 96.2 ± 0.4 |

Figure 4A:
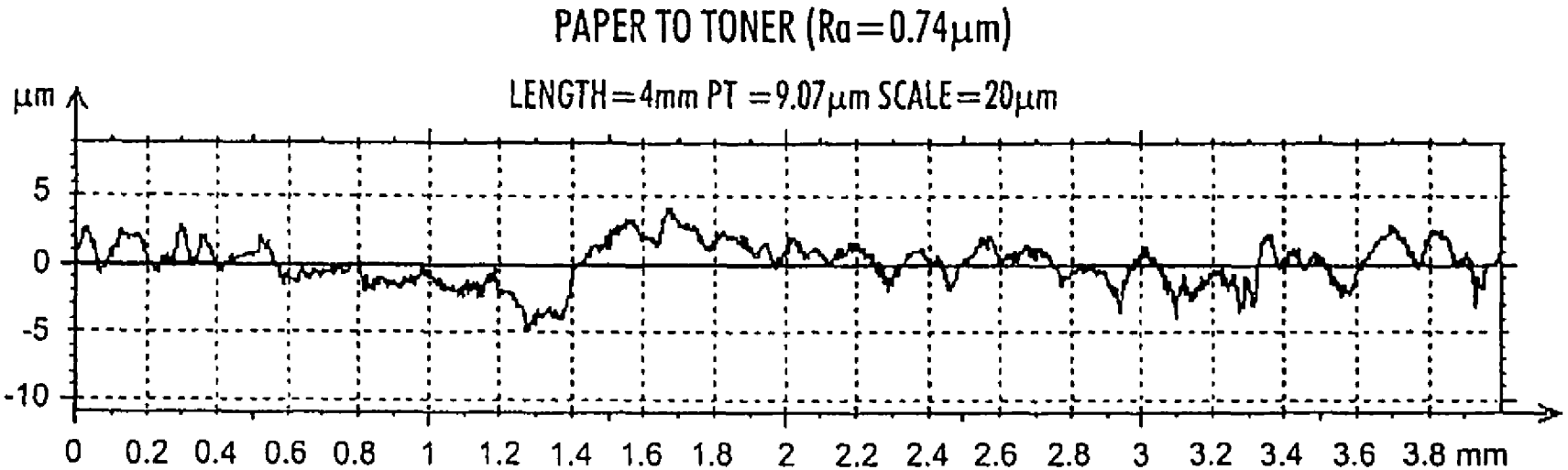
FIGS. 4A and 4B are graphs illustrating surface roughness of ColoTech+GC (210 gsm) paper with and without an inventive overprint composition.
Figure 4B:
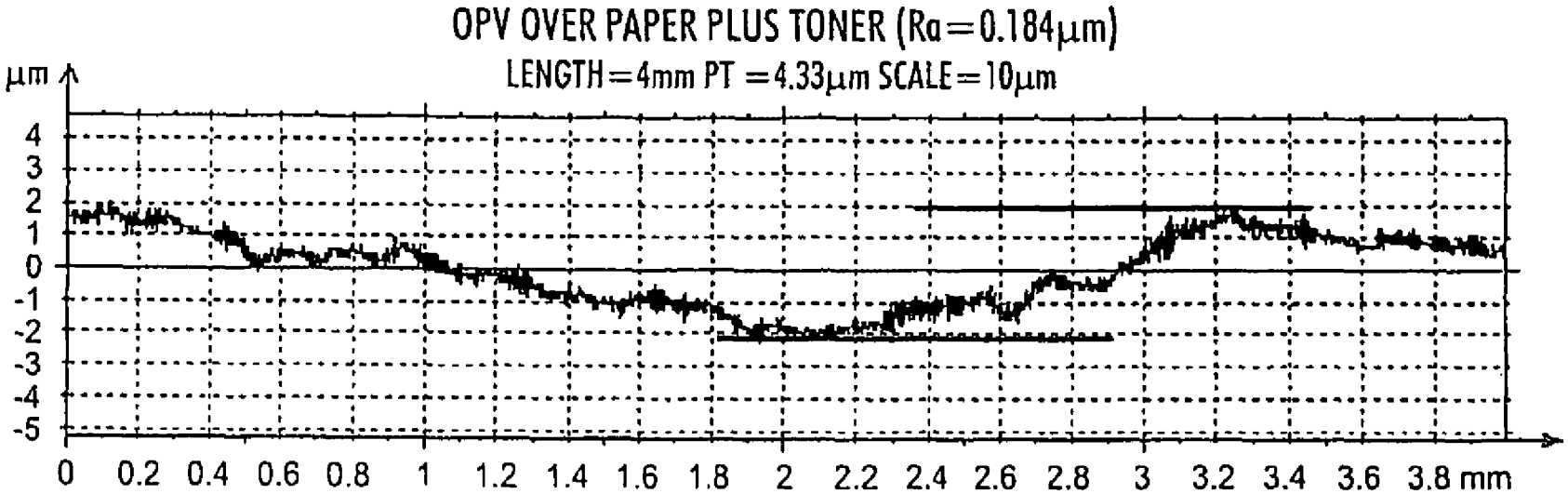

The surface roughness (Ra) of the paper to toner edge also improved when the overprint composition was applied (FIGS. 4A-4B). As shown in FIG. 4A, the uncoated print had an Ra value of 0.74 μm, whereas the coated print, shown in FIG. 4B, had an Ra value of 0.184 μm.

Example 5

Audi Thermal Shock Test for Measuring Thermal Cracking

A commercially available coating (#L9048 from Sovereign Chemicals (Sovereign Specialty Chemicals, Inc.)) was applied to several substrates containing either iGen3® (Xerox Corp.) toner or offset ink. The substrates were then subjected to the "Audi Thermal Shock Test" with 4 g/cm$^2$ pressure (simulating approximately 2 reams of CX paper) under the various conditions set forth in Table 4. This test is an actual test used by Audi in evaluating its automobile manuals.

TABLE 4

Audi Thermal Shock Test

| Temperature | Time |
|---|---|
| Increase temperature from 23° C. (room temp.) to 70° C. | 2 hours |
| Hold @ 70° C. | 4 hours |
| Decrease temperature from 70° C. to −40° C. | 2 hours |
| Hold @ −40° C. | 4 hours |
| Increase temperature from −40° C. to 70° C. | 2 hours |
| Hold @ 70° C. | 4 hours |
| Decrease temperature from 70° C. to −40° C. | 2 hours |
| Hold @ −40° C. | 4 hours |
| Increase temperature from −40° C. to 23° C. | 2 hours |

The key indicator of thermal cracking in the Audi Thermal Shock Test is the appearance of cracks on the substrate due to pressure from flowing toner. The offset ink-based prints showed no indication of cracking under the coating material in the Audi Thermal Shock Test, whereas the toner-based prints did show cracks (Table 5). The substrates were McCoy Gloss (Sappi Fine Papers), McCoy Silk (Sappi Fine Papers), and KromeKote® (Smart Papers, LLC, Hamilton, Ohio).

TABLE 5

Thermal Cracking of iGen3 ® (Xerox Corp.) Toner vs. Offset Ink (Roll = 50, Line = 100, Lamp = 300, Thickness = nominal)

| Sample No. | Coating | Substrate | Toner/Offset Ink | Cracking |
|---|---|---|---|---|
| 1 | L9048 | KromeKote ®+ | Toner | Yes |
| 1 | L9048 | McCoy Silk | Toner | Yes |
| 1 | L9048 | McCoy Gloss | Toner | Yes |
| 2 | L9048 | McCoy Gloss | Ink | No |
| 2 | L9048 | McCoy Silk | Ink | No |
| 2 | L9048 | KromeKote ®+ | Ink | No |

Example 6

Comparative Example Using the Audi Thermal Shock Test

Two commercial coatings (Sovereign Chemicals #L9048 (Sovereign Specialty Chemicals, Inc.) and Sun Chemicals #1170 (Sun Chemical Corp.)) and the overprint composition of Example 1 were evaluated under identical conditions and subjected to the Audi Thermal Shock Test. The coated substrates, McCoy Gloss 100# Cover (Sappi Fine Papers) and Xerox® Digital Gloss 100# Cover (Xerox Corp.), with iGen3® (Xerox Corp.) toner-based images thereon were subjected to the Audi Thermal Shock Test with 4 g/cm$^2$ pressure (simulating approximately 2 reams of CX paper) under the various conditions set forth in Table 4.

Figure 5A:
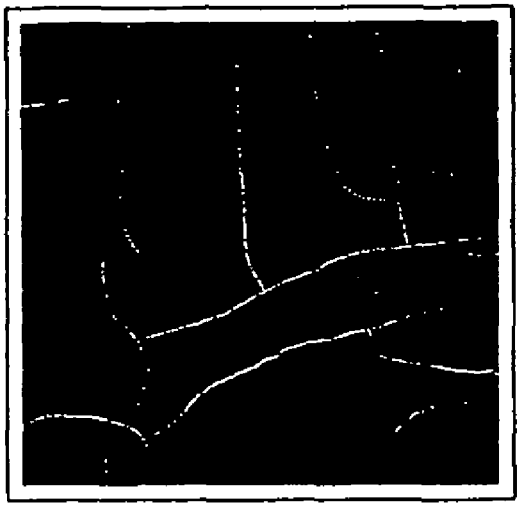
FIGS. 5A-5F are photographs illustrating thermal cracking on prints coated with Sun Chemicals coating #1170 (Sun Chemical Corp., New York, N.Y.), Sovereign Chemicals coating #L9048 (Sovereign Specialty Chemicals, Inc., Chicago, Ill.), and an inventive overprint composition.
Figure 5B:
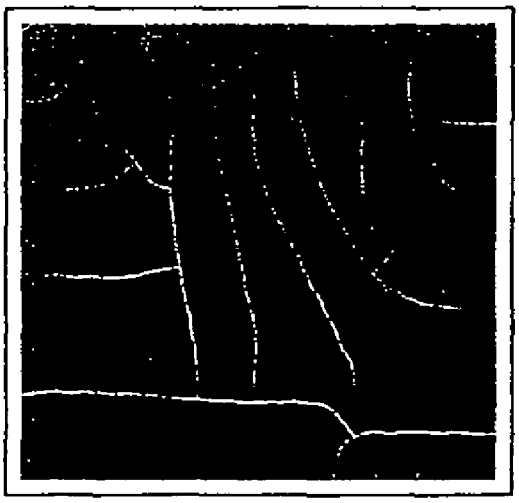
Figure 5C:
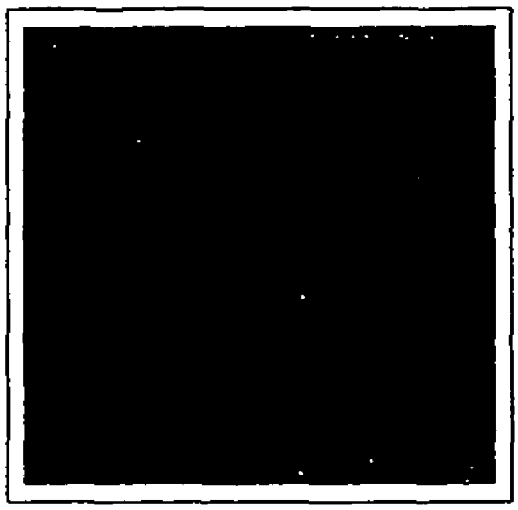
Figure 5D:
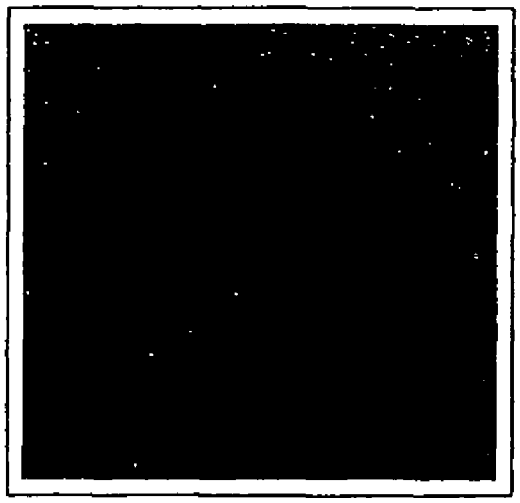
Figure 5E:
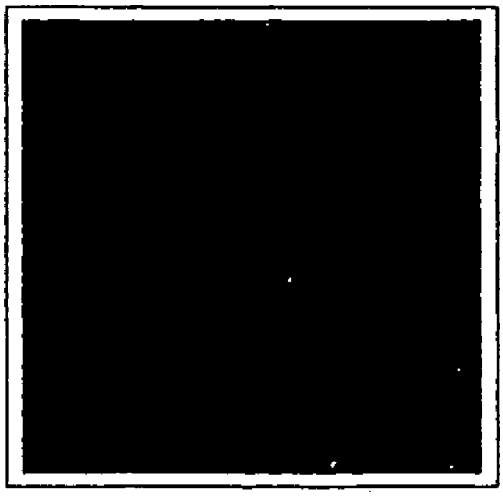
Figure 5F:
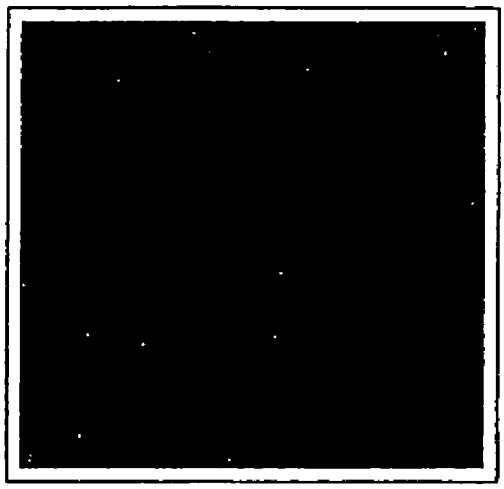

FIG. 5 illustrates that severe thermal cracking occurred using the Sun Chemicals #1170 (Sun Chemical Corp.) coating (FIGS. 5A-5B), substantial thermal cracking occurred using the Sovereign Chemicals #L9048 (Sovereign Specialty Chemicals, Inc.) coating (FIGS. 5C-5D), and no thermal cracking occurred using the inventive overprint composition (OPV-3) (FIGS. 5E-5F). Table 6 confirms the results shown in FIGS. 5A-5F.

TABLE 6

Thermal Cracking (Roll = 50, Line = 100, Lamp = 300, Thickness = nominal)

| Sample No. | Coating | Substrate | Cracking |
|---|---|---|---|
| 6 | Sun Chemicals #1170 | McCoy Gloss | Yes |
| 6 | Sun Chemicals #1170 | Xerox ® Digital Gloss | Yes |
| 1 | Sovereign Chemicals #L9048 | McCoy Gloss | Yes |
| 1 | Sovereign Chemicals #L9048 | Xerox ® Digital Gloss | Yes |
| 3 | OPV-3 | McCoy Gloss | No |
| 2 | OPV-3 | Xerox ® Digital Gloss | No |

Example 7

Marker Test—Comparative Example

Two commercial coatings, Sovereign Chemicals #L9048 (Sovereign Specialty Chemicals, Inc.) and Sun Chemicals #1170 (Sun Chemical Corp.), and the overprint composition of Example 1 were evaluated under identical conditions and subjected to a marker test using a Sanford Green Sharpie® Fine Point Permanent Marker, a Sanford Black Uniball Liquid Ink Vision Fine Tipped Pen, and a green generic-brand highlighter. Substrates, Xerox® Digital Colour Gloss 100# (Xerox Corp.) and McCoy Gloss 100# (Sappi Fine Papers), were coated and subjected to UV curing under a UV lamp at room temperature.

The Sharpie®, Uniball pen, and highlighter marks were all clear and distinct on the inventive overprint composition coated print. However, on the Sun Chemicals #1170 coated print, the Sharpie® and highlighter "beaded-up" and could easily be wiped off. On the Sovereign Chemicals #L9048 coated print, the Uniball pen did not even leave a mark and the Sharpie® and highlighter "beaded-up" to an even larger degree than on the Sun Chemicals #1170 coated print.

Example 8

Electron Beam Radiation Test

Xerographic prints on Xerox® Digital Colour Gloss 100# (Xerox Corp.) were left uncoated or coated with approximately 5 gsm of the overprint composition of Example 1 and subjected to a normal dose of electron beam irradiation, i.e., the prints were run through an electron beam system twice, wherein the temperature was approximately 95-110° C. The steaming prints were allowed to cool naturally for several hours and then observed.

As described in Table 7, the coated prints successfully survived the irradiation process indicating a resistance to both the irradiation and the secondary heat to which the prints were subjected during the irradiation process. The first two samples in Table 7 represent different types of mail, e.g., folded versus not folded.

TABLE 7

E-Beam Irradiation on Xerographic Prints

| Toner | Paper | Overcoat | Comment |
|---|---|---|---|
| iGen3 ® | Coated | None | solid block, severe offset damage |
| iGen3 ® | Coated | None | in contact with other paper, could be peeled, severe offset damage, paper tearing |
| iGen3 ® | Coated | Yes (Example 1) | no sticking, no damage |
| NexPress ® | Coated | None | severe damage |

Toner = iGen3 ® (Xerox Corp.) or NexPress ® (NexPress Solutions, Rochester, NY)

While the invention has been described with reference to the specific embodiments, it will be apparent to those skilled in the art that many alternatives, modifications, and variations can be made. It is intended to embrace such alternatives, modifications, and variations as may fall within the spirit and scope of the appended claims.

All the patents, publications, and articles referred to herein are hereby incorporated by reference in their entirety.

What is claimed is:

1. A xerographic print, comprising:

a substrate with a toner-based image, and a cured overprint composition coated over at least the toner-based image, wherein the cured overprint composition before curing has a viscosity of from about 50 cP to about 300 cP at about 25° C. and a surface tension of from about 15 to about 40 dynes/cm at about 25° C. and comprises:

at least one radiation curable acrylated polyester or acrylated polyether, at least one radiation curable polyfunctional alkoxylated or polyalkoxylated acrylic monomers comprising one or more di- or tri-acrylate, at least one photoinitiator, and at least one surfactant, wherein, upon curing, the xerographic print resists document offset up to about 100° C., and wherein the toner-based image has residual release oil chosen from silicon oils and functionalized silicone oils present on the image, the residual release oil covering the substrate and the toner-based image at levels from 5% to 100% on an area basis and at levels from 0.2 to 50 $\mu g/cm^2$ and wherein the surface energy in areas covered by residual fuser oil is as low as 15 mN/m.

2. The xerographic print according to claim 1, wherein the silicon oil is a polydimethylsiloxane.

3. The xerographic print according to claim 1, wherein the functionalized silicon oils are chosen from amino-functionalized PDMS oils and mercapto-functionalized PDMS oils.

4. The xerographic print according to claim 1, wherein the overprint composition before curing comprises two or more different radiation curable amine-modified polyether acrylates.

5. The xerographic print according to claim 1, wherein the at least one radiation curable polyfunctional alkoxylated or polyalkoxylated acrylic monomers comprises one or more di- or tri-acrylate.

6. The xerographic print according to claim 1, wherein the photoinitiator is selected from the group consisting of hydroxycyclohexylphenyl ketones, trimethylbenzophenones, polymeric hydroxy ketones, trimethylbenzoylphenylphosphine oxides, and mixtures thereof.

7. The xerographic print according to claim 1, wherein the photoinitiator is 1-hydroxycyclohexylphenyl ketone.

8. The xerographic print according to claim 1, wherein the photoinitiator is a mixture of 1-hydroxycyclohexylphenyl ketone and ethyl-2,4,6-trimethylbenzoylphenylphosphinate.

9. The xerographic print according to claim 1, wherein the photoinitiator comprises two to five different photoinitiators.

10. The xerographic print according to claim 1, wherein the surfactant is a polyether modified polydimethylsiloxane or a fluorosurfactant.

11. The xerographic print according to claim 1, wherein the surfactant comprises two to five different surfactants.

12. The xerographic print according to claim 1, wherein the overprint composition before curing comprises about 30 to about 80 wt % of an amine-modified polyether acrylate, about 20-40% polyalkoxylated acrylic monomer, about 2 to about 7 wt % of the photoinitiator, and about 0.05 to about 5 wt % of the surfactant.

13. The xerographic print according to claim 1, wherein the overprint composition before curing further comprising an additive selected from the group consisting of light stabilizers, UV absorbers, antioxidants, optical brighteners, thixotropic agents, dewetting agents, slip agents, foaming agents, antifoaming agents, flow agents, waxes, silica, oils, plasticizers, binders, electrical conductive agents, fungicides, bactericides, organic and inorganic filler particles, leveling agents, opacifiers, antistatic agents, dispersants, and colorants.

14. A method of making a xerographic print, comprising:

providing a substrate with a toner-based image thereon, and coating at least the toner-based image with a cured overprint composition, wherein the cured overprint composition before curing has a viscosity of from about 50 cP to about 300 cP at about 25° C. and a surface tension of from about 15 to about 40 dynes/cm at about 25° C. and comprises:

at least one radiation curable acrylated polyester or acrylated polyether, at least one radiation curable polyfunctional alkoxylated or polyalkoxylated acrylic monomer comprising one or more di- or tri-acrylate at least one photoinitiator, and at least one surfactant, and exposing the coated image to a radiation source for sufficient time to at least substantially cure the radiation curable components of the composition, wherein the toner-based image has residual release oil chosen from silicon oils and functionalized silicone oils present on the image, the residual release oil covering the substrate and the toner-based image at levels from 5% to 100% on an area basis and at levels from 0.2 to 50 $\mu g/cm^2$ and wherein the surface energy in areas covered by residual fuser oil is as low as 15 mN/m.

15. The method of making a xerographic print according to claim 14, wherein the silicon oil is a polydimethylsiloxane.

16. The method of making a xerographic print according to claim 14, wherein the functionalized silicon oils are chosen from amino-functionalized PDMS oils and mercapto-functionalized PDMS oils.

17. The method of making a xerographic print according to claim 14, wherein the radiation source is ultraviolet light.

18. The method of making a xerographic print according to claim 14, wherein the exposing comprises irradiating the coated image with ultraviolet radiation at a wavelength of about 200 to about 500 nm at a speed of about 20 to about 70 m/minute for about less than 1 second.

19. The method of making a xerographic print according to claim 14, wherein the providing comprises:

providing a substrate, and forming a toner-based image on the substrate by an electrographic process that utilizes silicone oil as a release agent.

20. A printing system for creating a durable toner-based image on a substrate comprising:

a xerographic print engine connected to a liquid film coating device and curing station, wherein the liquid film coating device applies an overprint composition comprising:

at least one radiation curable acrylated polyester or acrylated polyether, at least one radiation curable polyfunctional alkoxylated or polyalkoxylated acrylic monomers comprising one or more di- or tri-acrylate, at least one photoinitiator, and at least one surfactant;

wherein the composition has a viscosity of from about 50 cP to about 300 cP at about 25° C. and a surface tension of from about 15 to about 40 dynes/cm at about 25° C., and wherein the toner-based image has residual release oil chosen from silicon oils and functionalized silicone oils present on the image, the residual release oil covering the substrate and the toner-based image at levels from 5% to 100% on an area basis and at levels from 0.2 to 50 $\mu g/cm^2$ and wherein the surface energy in areas covered by residual fuser oil is as low as 15 mN/m.

21. The printing system according to claim 20, further comprising a radiation source for curing the overprint composition on the substrate.

22. The printing system according to claim 20, wherein the radiation source is an ultraviolet light.

23. The printing system according to claim 20, wherein the toner-based image is obtained by generating an electrostatic latent image on the photoconductive imaging member, developing the latent image with the toner, transferring the developed electrostatic image to the substrate, and coating the substrate or parts thereof and/or image or parts thereof with the overprint composition.

* * * * *